United States Patent [19]

Opsvik

[11] Patent Number: 4,767,159

[45] Date of Patent: Aug. 30, 1988

[54] CHAIR HAVING SUPPORTING MEMBER FOR THE POSTERIOR AND THE SHINS, RESPECTIVELY, OF A CHAIR OCCUPANT

[76] Inventor: Peter Opsvik, Hogtunveien 12, N-1370 Asker, Norway

[21] Appl. No.: 869,834

[22] Filed: May 23, 1986

Related U.S. Application Data

[63] Continuation of Ser. No. 675,837, filed as PCT NO84/00014 on Mar. 15, 1984, published as WO84/03614 on Sep. 27, 1984, abandoned.

[30] Foreign Application Priority Data

Mar. 17, 1983 [DE] Fed. Rep. of Germany ... 8307879[U]
May 4, 1983 [DE] Fed. Rep. of Germany ... 8313203[U]

[51] Int. Cl.[4] ..... A47C 7/50

[52] U.S. Cl. ..... 297/423; 297/195; 297/149; 297/172

[58] Field of Search ..... 297/423, 437, 195, 149, 297/170–172, 174, 347, 300; 248/188.7, 157

[56] References Cited

U.S. PATENT DOCUMENTS

| | | | |
|---|---|---|---|
| 1,065,022 | 6/1913 | Bell | 297/195 X |
| 2,308,358 | 1/1943 | Cramer | 297/437 |
| 2,521,422 | 9/1950 | Strand | 297/149 X |
| 2,554,490 | 5/1951 | Eames | 297/306 |
| 3,008,764 | 11/1961 | Pile | 297/306 |
| 3,669,493 | 6/1972 | Vowles | 297/423 X |
| 3,891,270 | 6/1975 | Crossman et al. | 297/347 |
| 4,328,991 | 5/1982 | Mengshoel et al. | 297/423 X |
| 4,373,756 | 2/1983 | Purdy et al. | 297/149 X |
| 4,377,309 | 3/1983 | Mengshoel | 297/423 |

FOREIGN PATENT DOCUMENTS

| | | | |
|---|---|---|---|
| 0018812 | 11/1980 | European Pat. Off. | 297/172 |
| 3246088 | 6/1984 | Fed. Rep. of Germany | 297/423 |
| 379713 | 8/1964 | Switzerland | 297/172 |
| 1239729 | 7/1971 | United Kingdom | 297/347 |

*Primary Examiner*—Kenneth J. Dorner
*Assistant Examiner*—Laurie K. Cranmer
*Attorney, Agent, or Firm*—Darby & Darby

[57] ABSTRACT

A chair having supporting members for the seat and the shins, respectively, of a chair occupant, said supporting member being mechanically interconnected. A frame part (3; 25) interconnects the two supporting members (1, 2) and a supporting column (10) extends downward from said frame part (3; 25), and at its lower end is provided with a base (13; 14–18; 19–22) e.g. a base having legs, provided with roller members (23). A table assembly (32–41) may be attached to the chair through a transverse member (4) provided at the front and lowermost end of the frame part (3). The chair is intended for a kneeling-like sitting posture of a chair occupant.

4 Claims, 12 Drawing Sheets

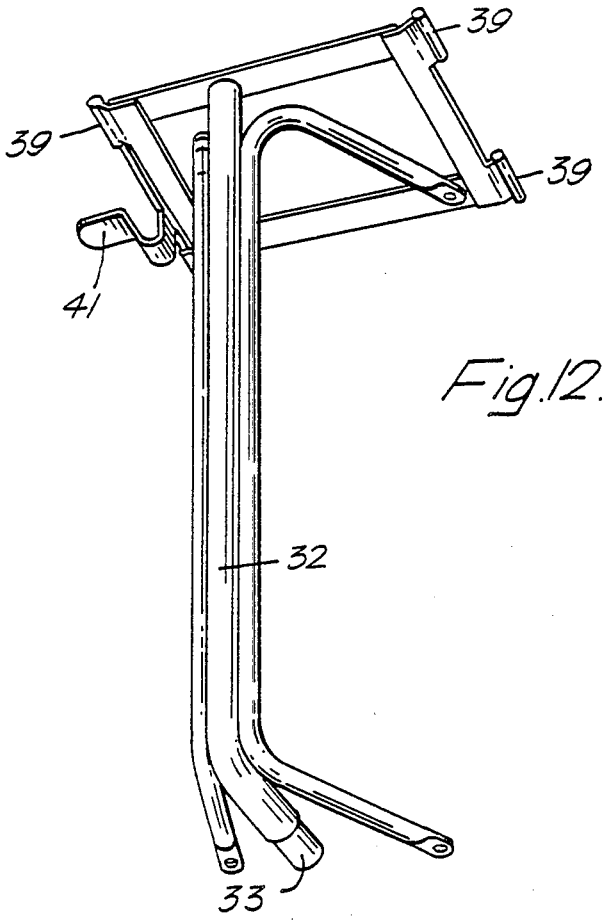
Fig.12.
Fig.13.
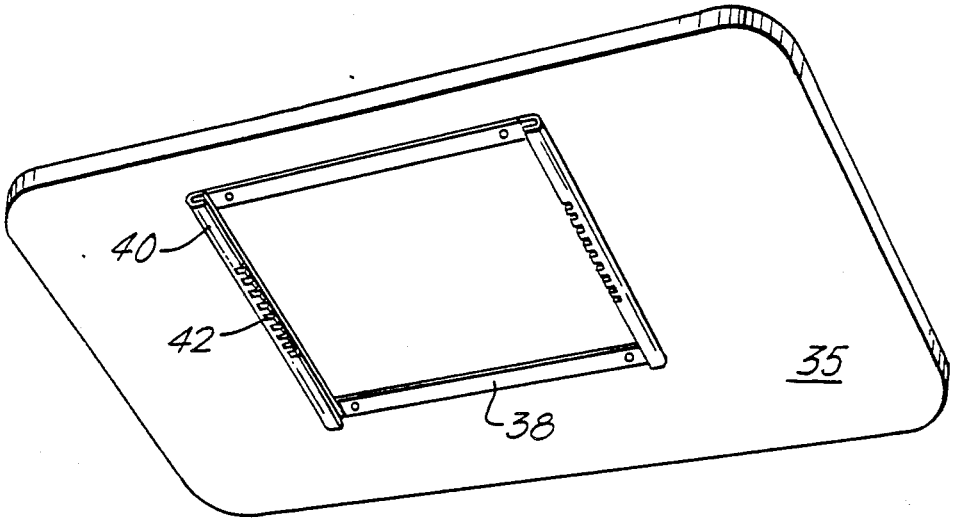

CHAIR HAVING SUPPORTING MEMBER FOR THE POSTERIOR AND THE SHINS, RESPECTIVELY, OF A CHAIR OCCUPANT

This is a continuation, of application Ser. No. 675,837, filed as PCT NO84/00014 on Mar. 15, 1984, published as WO84/03614 on Sep. 27, 1984, now abandoned.

The present invention relates to a chair having supporting members for the posterior and the shins, respectively, of a chair occupant, said supporting members being mechanically interconnected.

Such a chair is inter alia known from the German industrial design MR No. 18742 and European patent application No. 80.301.394.5 (publication No. 0018812). Further, from DE-OS No. 2334400 it is known a chair with respective supporting means extending from a base on the floor and where the respective supporting members are individually adjustable as regards level above the base. This solution will be impractical in use, and it does not offer any possibility for turning in the chair without the shins disengaging the shin supporting means.

Thus, it has been desirable to provide a chair which may easily be adjusted in level, which requires a minimum of space and simultaneously is movable on a floor. It is also desirable to provide easy means for attaching a work table to a chair of this kind.

In order to fullfill these requirements, the invention proposes a chair, the characterizing features of which will appear from the attached claim 1 as well as the subclaims depending therefrom.

The invention will be described below with reference to the enclosed drawings.

FIG. 12 illustrates the work-table device.

FIG. 13 illustrates construction of the work-table from below.

Figure 1:
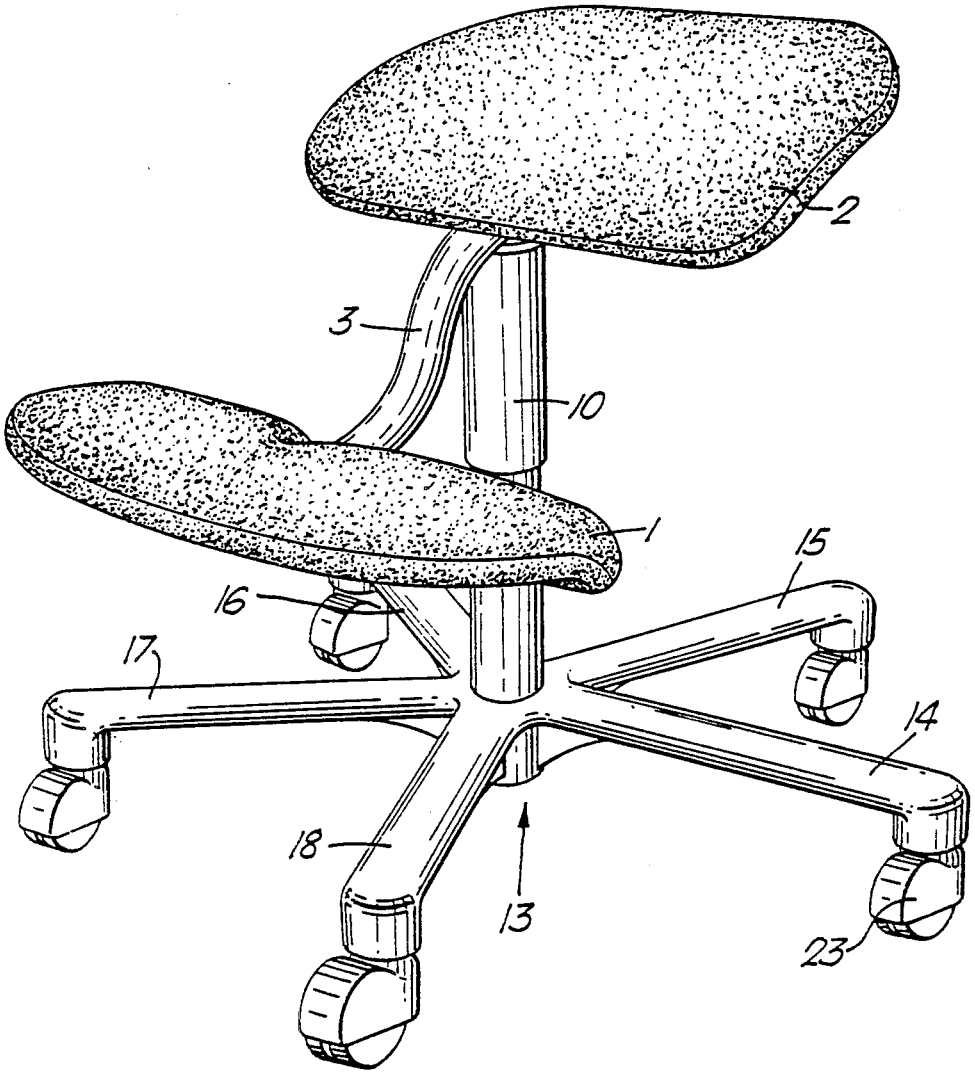
FIGS. 1 and 2 illustrate a first embodiment of the chair.

The supports for the shins and the posterior are indicated by the reference numerals 1 and 2, respectively, in FIG. 1. These supporting members are interconnected by means of an inclined frame part 3, e.g. a metal tube. The metal tube may, as appears from FIG. 8, have e.g. the form of an S. The frame part 3 has at its lower end a transverse member 4, which by means of bolts 5 is attached to the shin support 1. In order to provide that the supporting members to a certain extent yield upon the positioning of the shins of the chair user, elastic means 6, e.g. rubber blocks are located between the transverse member 4 and the support 1. These rubber blocks 6 may of course be replaced by a rubber plate, as will be described below.

Figure 10:
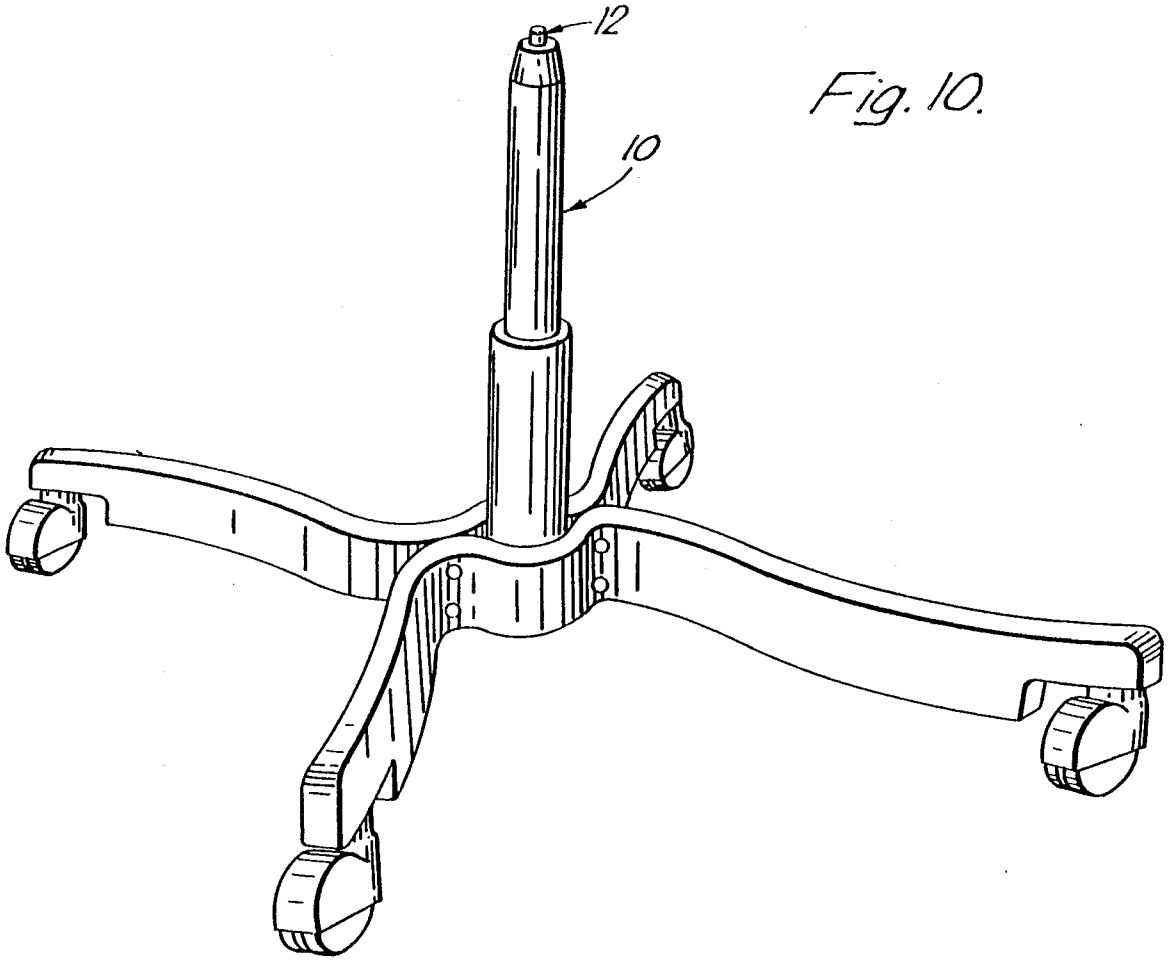
FIG. 10 illustrates the lifting and lowering mechanism of FIGS. 1–3.

At the upper end of the frame part 3, an attachment means 7 has been provided, by means of which the support 2 for the posterior may be connected to the frame part 3, e.g. by means of screws 8. A release arm 9 is in addition provided at the upper region of the frame part, which release arm upon operation,controls a lifting- and lowering mechanism 10, known per se, as will appear from FIGS. 1–3. The lifting and lowering mechanism may be of any type shown in the art for lifting and lowering chairs, for example a conventional gaslift. The upper end of the mechanism fits into an attachment female member 11 located on the frame part 3. The releasing means for the mechanism 10 is labelled 12 in FIG. 10. Upon operation of the arm 9, the pin 12 is acted upon, whereby the mechanism 10 is released, and the said supporting members may then in a single operation be lifted or lowered to the level which suits the user.

It is, however,readily understood that the mechanism 10 may be replaced by a conventional level adjustment mechanism, e.g. of the kind having a clamping device.

Figure 2:
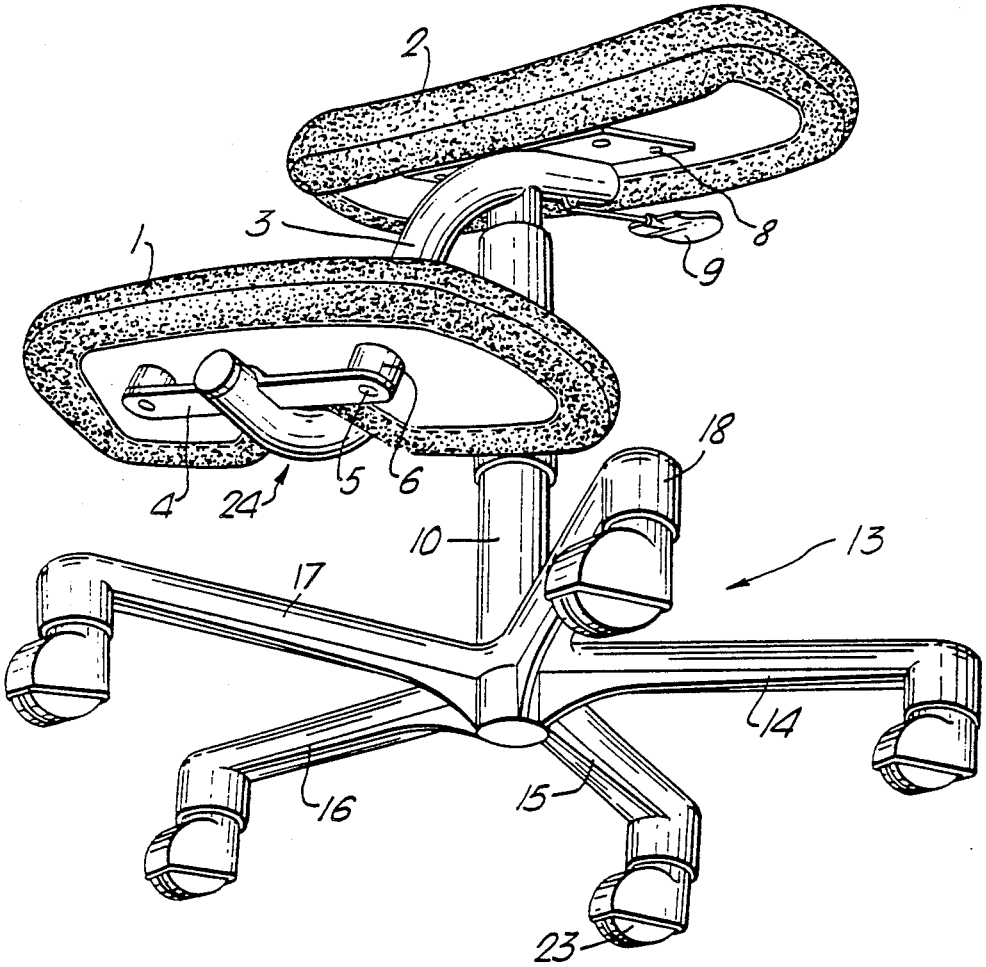
Figure 3:
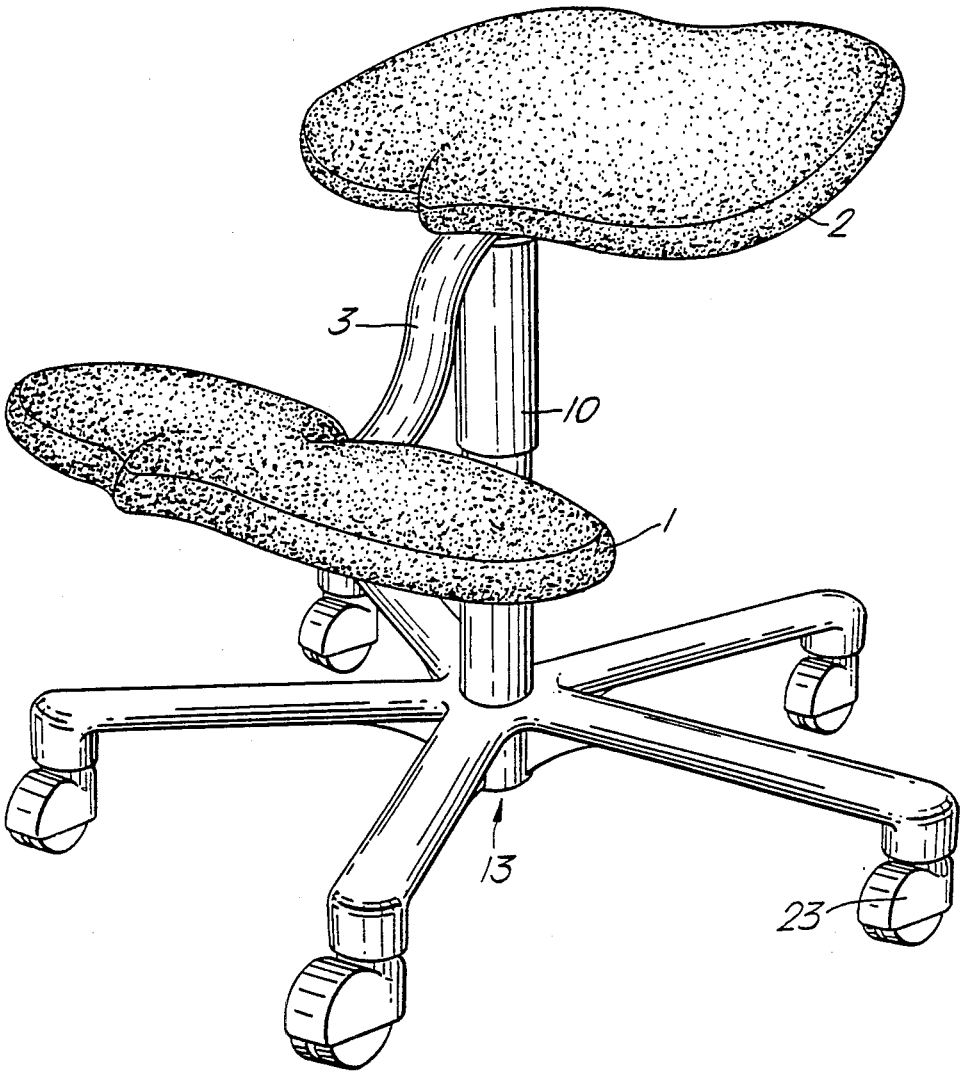
FIG. 3 illustrates a second embodiment of the chair.
Figure 6:
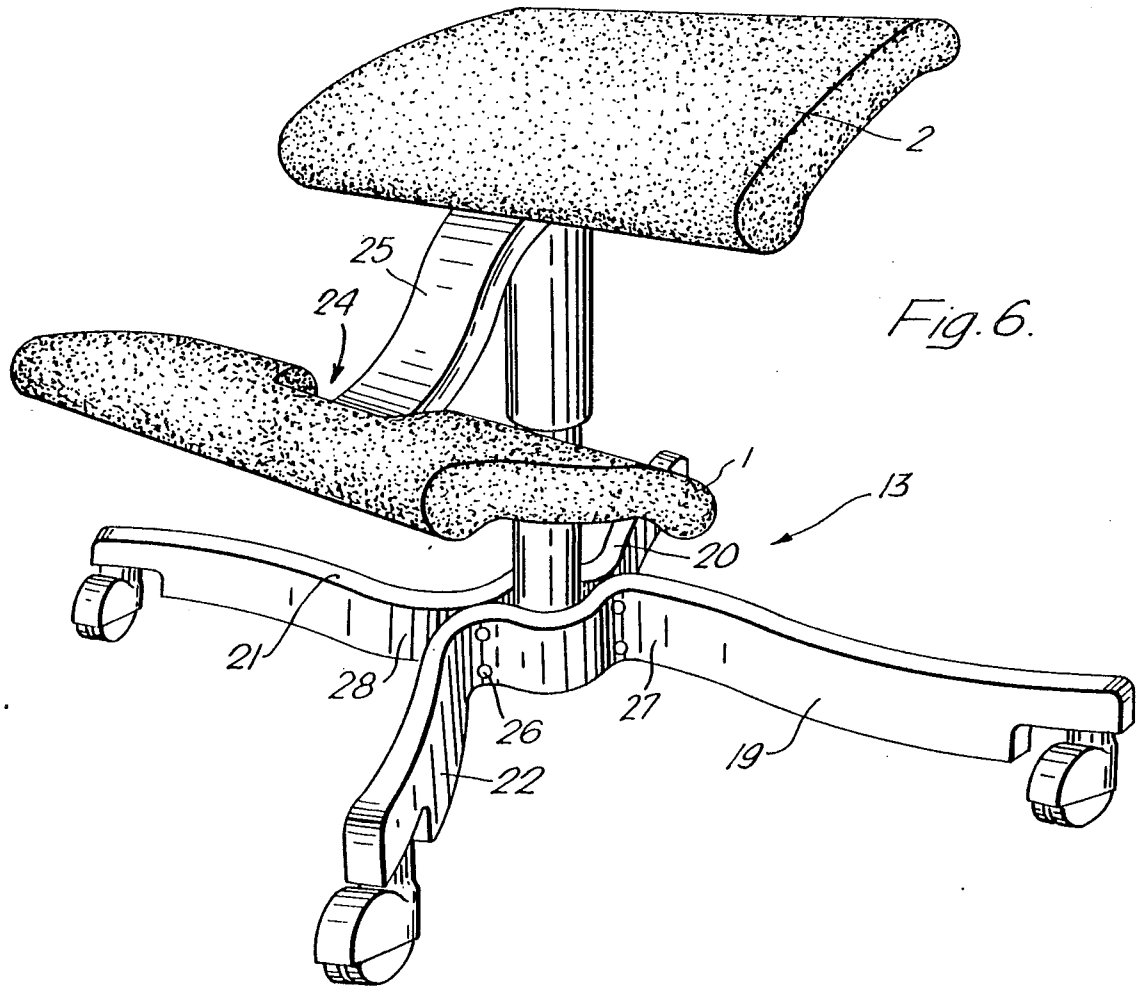
Figure 7:
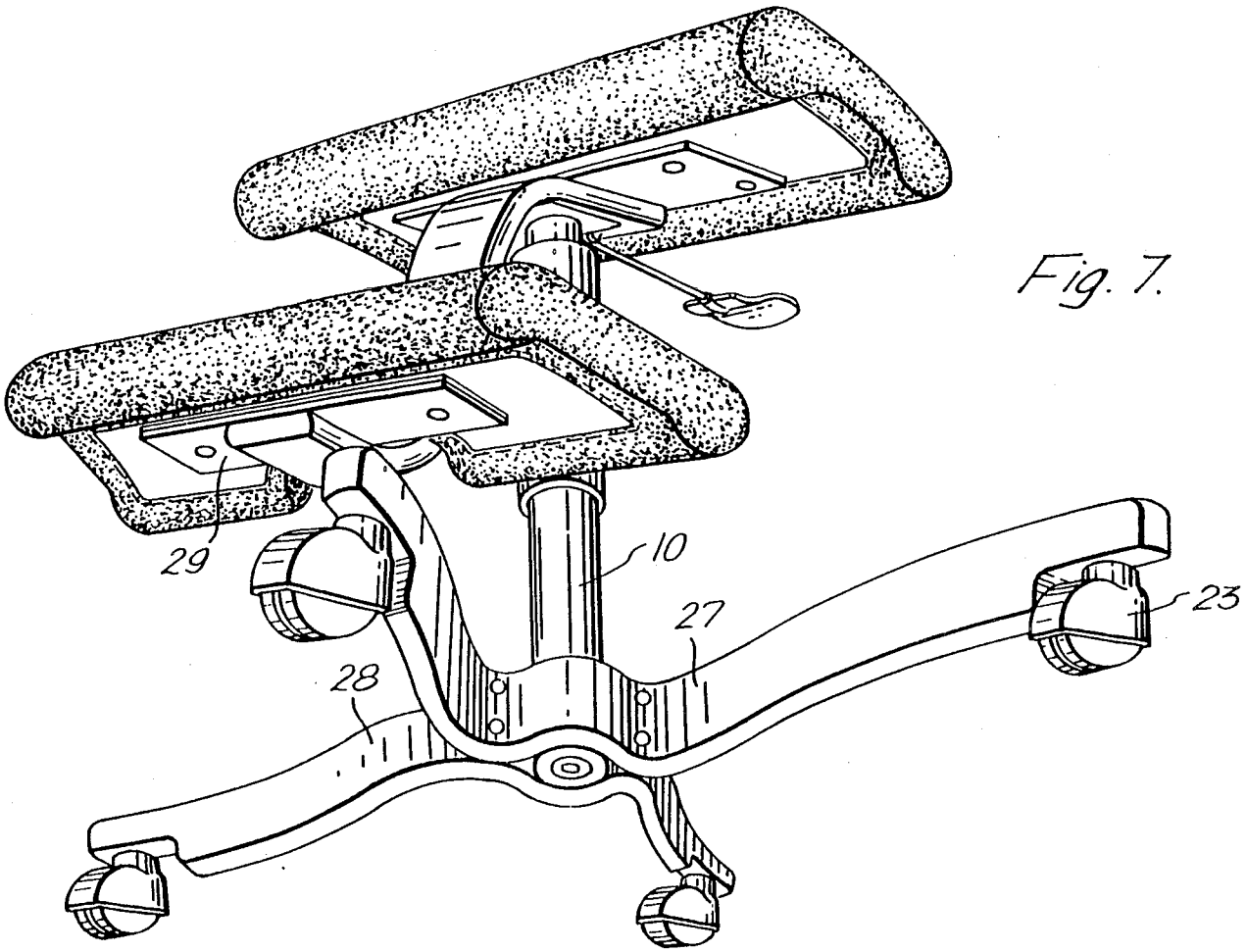

The lifting and lowering mechanism is at its bottom terminated by a base member 13, which e.g. has four or five legs, such as the legs 14, 15, 16, 17 and 18 in FIGS. 1–3, or the legs 19, 20, 21 and 22 in FIGS. 6 and 7. These legs 14–18 and 19–22, respectively, are at their respective free outer ends provided with roller means 23, which provide the chair with the desirable mobility. In this manner, transfer a chair is obtained which is adjustable both as regards level as well as being turnable about the vertical axes, since the parts of the mechanism 10 are mutually coaxially turnable, and together with the rollers 23 operating in the horizontal plane, provide an improved mobility, being of importance e.g. when adjusting the distance from a table, a desk or the like.

Figure 4:
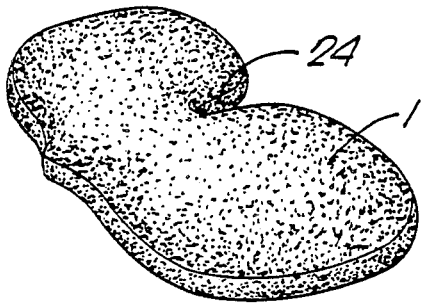
FIGS. 4 and 5 illustrate a detailed view of the shin and posterior supporting member, respectively, in FIG. 3.
Figure 5:
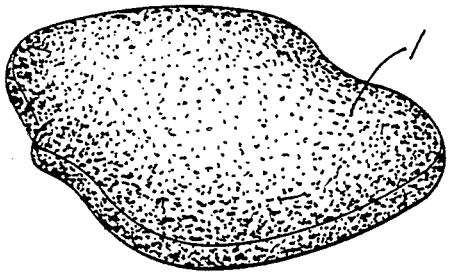

As will appear from FIGS. 1, 4 and 6, the supporting member 1 has preferably a recess 24, in order to provide the best possible shape of the frame part 3. It is, however, within the scope of the invention that the supporting member 1 not necessarily will have a design as indicated, e.g. when the lower part of the frame is fully adapted to the shape of the supporting member 1. The supporting members 1 and 2 may in such case have substantially the same design. The supporting members 1 and 2 as shown in FIGS. 4 and 5 have in the example shown a heart shape, although these supporting means may equally well have a substantially rectangular form, e.g. with rounded corners, as shown in FIGS. 1–2 and 6–7.

A modified embodiment of that in FIGS. 1–3 is illustrated in FIGS. 6 and 7. The frame part, which in FIGS. 1–3 is made from a tube, is in the modified embodiment made of laminated wood and is labelled 25. The legs of the base 13 are made of two parts 27 and 28, which are joined together by means of screw connections 26 or the like, thereby encompassing the lifting/lowering mechanism 10 at the lower region thereof. As clearly appears from FIGS. 6 and 7, as well as from FIGS. 1–3, the legs have at their respective outer free end roller means 23.

Figure 8:
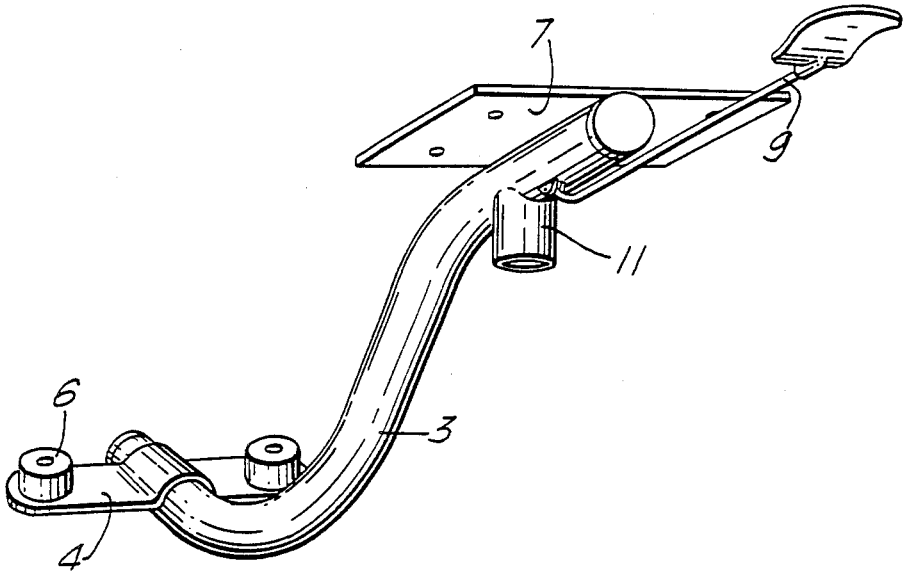
FIGS. 8 and 9 illustrate the frame member extending between the supporting members according to the embodiment of FIGS. 1–3, and FIGS. 6, 7, respectively.
Figure 9:
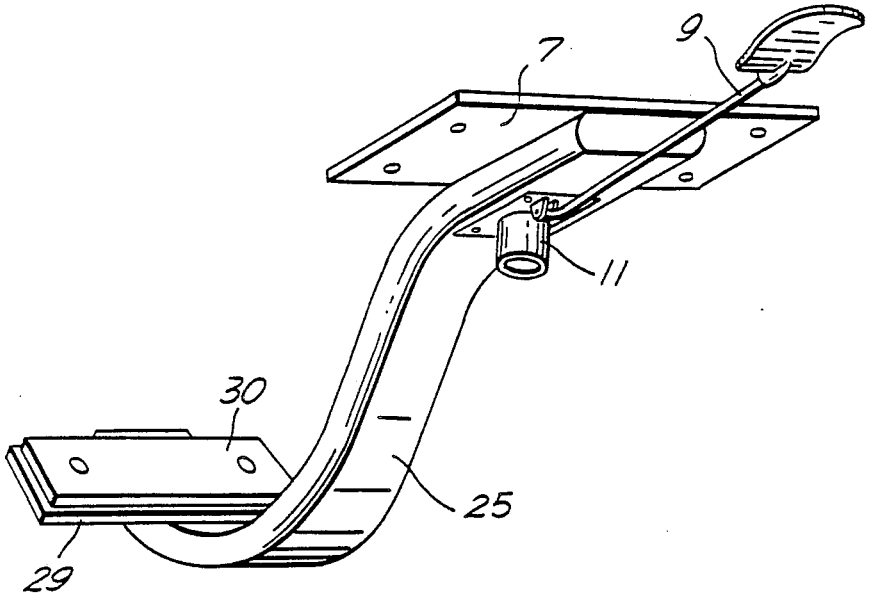

As will appear from FIG. 9, this embodiment of the frame part 25 departs somewhat from the solution according to FIG. 8, although the mode of operation is the same. At its lower end, a transverse member 29 has been attached, and on its upper face is provided a plate member 30 of elastic material, e.g. rubber. At its upper end, the frame part 25 is provided with the previously mentioned attachment member 7. Since the frame part 25 consists of laminated wood, the release arm 9 and the attachment female member 11 must be mounted on a bracket 31, which is screwed onto the frame part 25, as indicated in FIG. 9. The attachment of the supporting members 1 and 2 onto the frame part 25, is like that described in connection with FIGS. 1–3.

In order to provide a work-table on a chair of this kind, it is proposed to remove a sealing member from the front of the frame part tube 3 and insert a tube 32 into the front end of the said frame part tube 3. The end 33 of the tube 32 must therefore have a dimension which enables it to fit into the tubular front end of the frame 3. The tube 32 is substantially axial with the lower region of the frame part 3 in a forward direction and thereafter at the front edge of the supporting member 1 at the middle portion thereof substantially extends vertically upwards. The tube 32 is at its top provided with a supporting member 34 for the table top 35. Further, there are provided two laterally disposed supports 36, 37, which at their lower inwardly bent ends are attached to the outer ends of the transverse member 4 by means of the said screws 5 or by other screws which fit into holes in the transverse member 4.

Like the tube 32, the lateral supports 36, 37 are preferably also tubular and bent approximately like the tube 32. The vertical portion of the tube 32 is connected to the lateral supports by means of rivets, by welding or by screws. The lateral supports 36, 37 are at their upper ends bent in the direction of the supporting means 2 and are connected to the supporting means 34 at the rear end thereof, as will appear from FIG. 11.

Figure 11:
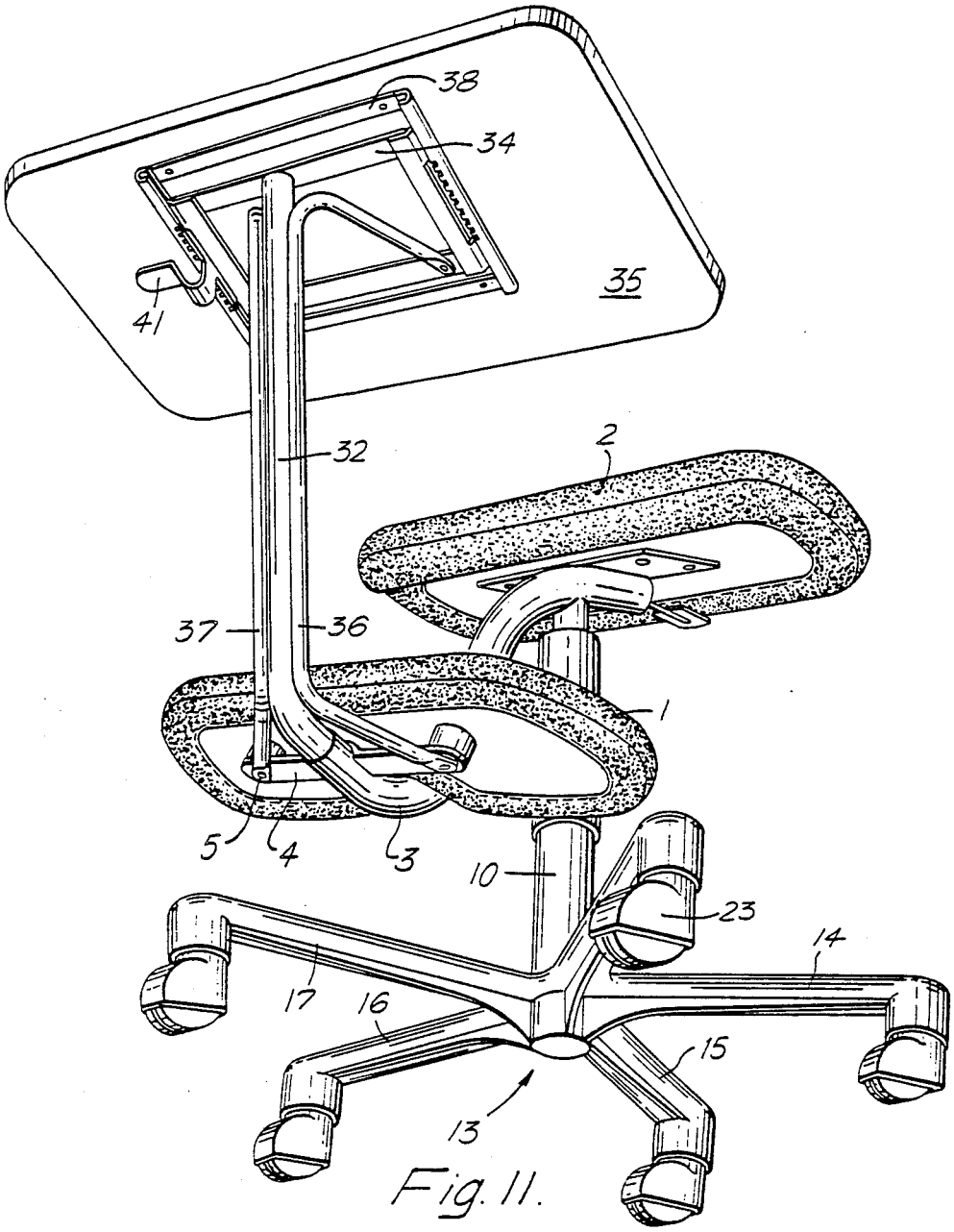
FIG. 11 illustrates a fourth embodiment of the chair provided with a work-table device.

As shown in FIGS. 11 and 13, the table top 35 is provided with a second attachment member 38, which is slidably connected to the first attachment member 34, in order that the distance between the supporting members 2 for the posterior and the table top 35 can be adjusted. From FIG. 12 it appears that the attachment member 38 is provided with slide means 39 which co-act with slide rails 40 on the said second attachment member 38. The table top may by means of an attachment arm 41 which is provided on the first attachment member 32 form engagement with teeth 42 provided on the slide rails 40 of the attachment member 38 thereby fixing the relative position of the first and second attachment members 34 and 38 in the preferred selected position.

In order to avoid that the chair with its installed table top tilts in a forward direction when a person sits on the chair, it is preferred that the base member either has sufficient weight to prevent such action or to let the arms of the base member have such length that sufficient stability is obtained.

In the case when the base member and the frame part 3 is made from laminated wood, it is within the scope of the invention to adapt the embodiment such that the tubular supports 32, 36, 37, e.g. can be made of laminated wood and be attached to the transverse member 4 and connected to the frame part 3 by means of a screw connection or a male/female connection. The attachment of the table support onto the attachment member 34 can be made in a manner known per se by means of suitably designed brackets.

Figure 14:
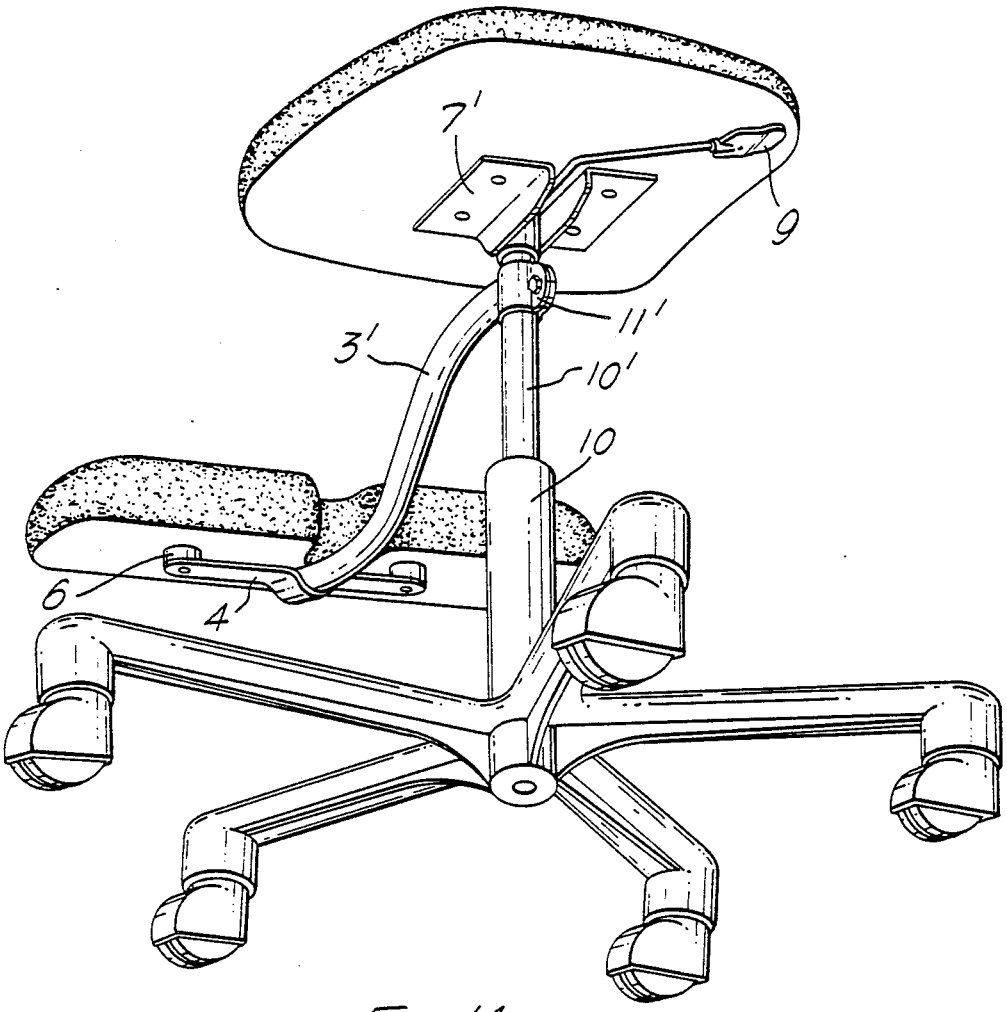
FIG. 14 illustrates a fifth embodiment of the chair according to the invention.

The embodiment of FIG. 14 is a minor variant of the previous embodiments shown in FIGS. 1–3. The lifting/lowering mechanism 10 has a centrally disposed member 10′, which upon operation of the release lever 9 will move relative to the lower, surrounding member of the mechanism 10. The frame part 3′ which forms a link between the supports for the shins and posterior of the chair occupant, is connected to the said centrally disposed member 10′ at the upper end thereof by means of a bracket 11′, as clearly shown. The attachment member for the posterior support is labelled 7′. The uppermost end of the member 10′ is attached to the attachment means 7′ by means of the previously described attachment female member 11.

It is readily understood that the embodiments described and shown only serve as examples and that these may be modified and replaced by technical equivalents without departing from the scope of the invention.

Further, it is possible to modify the shape of the supporting members for the shins and posterior, the mutual dimensions of the individual part, the number of legs in the base member, the configuration of the frame parts, the lifting/lowering mechanism etc. without departing from the scope of the invention.

By means of the present invention, there is provided a chair having a maximum of mobility while the person occupying the chair assumes a kneeling-like sitting posture.

I claim:

1. A chair adapted to support a person occupying the chair in a kneeling-like, sitting position, which comprises:

a substantially vertical supporting column;

means mounted to and disposed below the column for supporting the column in an upright, vertical position;

a substantially flat seat support means for supporting an occupant's posterior and substantially flat knee support means for engaging and supporting an occupant's shins from below in a kneeling-like, sitting position;

means for interconnecting the seat support means and the knee support means so that each faces substantially upwardly with the knee support means below and forward of the seat support means, the knee support means and seat support means being relatively positioned so that the shins of a chair occupant who is seated on the seat support means in a kneeling-like position engage and are supported upon the knee support means;

means for simultaneously adjusting the height of the seat support means and knee support means relative to said supporting column so that the seat support means and knee support means move in unison upon adjustment of the height;

a table top and a table top supporting column, the table top supporting column having a first end portion and a second end portion disposed opposite to the first end portion, the table top being mounted on the first end portion of the table top supporting column, the table top supporting column being fixedly secured at its second end portion to the seat and knee support interconnecting means.

2. A chair adapted to support a person occupying the chair in a kneeling-like, sitting position which comprises:

a substantially vertical supporting column;

means mounted to and disposed below the column for supporting the column in an upright, vertical position;

a substantially flat seat support means for supporting an occupant's posterior and substantially flat knee support means for engaging and supporting an occupant's shins from below in a kneeling-like sitting position;

means for interconnecting the seat support means and the knee support means so that each faces substantially upwardly with the knee support means below and forward of the seat support means, the knee support means and seat support means being relatively positioned so that the shins of a chair occupant who is seated on the seat support means in a kneeling-like position engage and are supported upon the knee support means;

said seat and knee support interconnecting means includes an elongated frame member, the frame member having a first end and a second end opposite the first end, the knee support means being mounted on the frame member in proximity to the first end thereof, the seat support means being mounted on the frame member in proximity to the second end thereof, the frame member being rotatably mounted to the vertical supporting column; and said interconnecting means further includes a first traverse member mounted transversely on the frame member and interposed between the frame member and the knee support means, and a second transverse member mounted transversely on the frame member and interposed between the frame member and the seat support means;

first and second resilient means respectively interposed between the first transverse member and the knee support means and the second transverse member and the seat support means; and means for simultaneously adjusting the height of the seat support means and knee support means relative to said supporting column so that the seat support means and knee support means move in unison upon adjustment of the height.

3. A chair adapted to support a person occupying the chair in a kneeling-like, sitting position, which comprises;

a substantially vertical supporting column;

means mounted to and disposed below the column for supporting the column in an upright, vertical position;

a substantially flat seat support means for supporting an occupant's posterior and substantially flat knee support means for engaging and supporting an occupant's shins from below in a kneeling-like, sitting position;

means for interconnecting the seat support means and the knee support means so that each faces substantially upwardly with the knee support means below and forward of the seat support means, the knee support means and seat support means being relatively positioned so that the shins of a chair occupant who is seated on the seat support means in a kneeling-like position engage and are supported upon the knee support means;

means for simultaneously adjusting the height of the seat support means and knee support means relative to said supporting column so that the seat support means and knee support means move in unison upon adjustment of the height;

said seat and knee support interconnecting means includes an elongated frame member, the frame member having a first end that a second end opposite the first end, the knee support means being mounted on the frame member in proximity to the first end thereof, the seat support means being mounted on the frame member in proximity to the second end thereof, the frame member being rotatably mounted to the vertical supporting column; and said knee support means includes an edge having a recess formed therein, the frame member being at least partially received by the recess.

4. A chair adapted to support a person occupying the chair in a kneeling-like, sitting position, which comprises:

a substantially vertical supporting column;

means mounted to and disposed below the column for supporting the column in an upright, vertical position;

a substantially flat seat support means for supporting an occupant's posterior and substantially flat knee support means for engaging an occupant's shins from below in a kneeling-like, sitting position;

means for interconnecting the seat support means and the knee support means so that each faces substantially upwardly with the knee support means below and forward of the seat support means, the knee support means and seat support means being relatively positioned so that the shins of a chair occupant who is seated on the seat support means in a kneeling-like position engage and rest upon the knee support means, said interconnecting means including an elongated frame member, the frame member having a first end and a second end opposite the first end, the knee support means being mounted on the frame member in proximity to the first end thereof, the seat support means being mounted on the frame member in proximity to the second end thereof, the frame member being rotatably mounted to the vertical supporting column;

said interconnecting means further including a first transverse member mounted transversely on the frame member and interposed between the frame member and the knee support means, and a second transverse member mounted transversely on the frame member and interposed between the frame member and the seat support means;

first and second resilient means respectively interposed between the first transverse member and the knee support means and the second transverse member and the seat support means;

means for simultaneously adjusting the height relative to said supporting column of the seat support means and knee support means so that the seat support means and knee support means move in unison upon adjustment of the height;

a table top;

a table top supporting column, the table top supporting column having a first end portion and a second end portion disposed opposite to the first end portion, the table top being mounted on the first end portion of the table top supporting column, the table top supporting column being fixedly secured at its second end portion to the seat and knee support interconnecting means, the table top supporting column including a central tube and first and second tubes extending axially adjacent to the central tube, each of the first and second tubes being mounted at one end thereof on the first transverse member, the central tube being mounted at one end thereof on the elongated frame member; and wherein the chair further comprises means for adjusting the position of the table top, the table top position adjusting means including a first frame part secured to the table top, and a second frame part secured to the table top supporting member, the first frame part engaging the second frame part and being selectively movable with respect to the second frame part to effect adjustment of the position of the table top.

* * * * *